United States Patent [19]

Freiborg

[11] 4,322,928

[45] Apr. 6, 1982

[54] ASPHALT COMPOSITION SHINGLES

[76] Inventor: Bennie Freiborg, 4536 Indiana Ave., La Canada, Calif. 91011

[21] Appl. No.: 135,466

[22] Filed: Mar. 31, 1980

[51] Int. Cl.[3] ..... E04D 1/20

[52] U.S. Cl. ..... 52/521; 52/540; 52/545; 52/554

[58] Field of Search ..... 52/520, 521, 518, 540, 52/545, 94–96, 554, 555

[56] References Cited

U.S. PATENT DOCUMENTS

| | | | |
|---|---|---|---|
| 420,707 | 2/1890 | Toner et al. | |
| 1,410,299 | 3/1922 | Harshberger | 52/545 |
| 1,435,623 | 11/1922 | Saxe | 52/518 |
| 1,471,396 | 10/1923 | Griswold . | |
| 1,596,272 | 8/1926 | Jordan | 52/545 |
| 1,810,674 | 6/1931 | Muhr | 52/96 |
| 1,822,410 | 8/1931 | Macan | 52/96 |
| 1,848,965 | 3/1932 | Miller | 52/540 |
| 1,975,986 | 10/1934 | Straub | 52/545 |
| 2,192,810 | 3/1940 | Angier . | |
| 2,253,753 | 8/1941 | Black | 52/545 |
| 2,305,008 | 12/1942 | Howard . | |
| 2,376,024 | 5/1945 | Barrett | 52/545 |
| 2,429,480 | 10/1947 | Miller . | |
| 3,913,294 | 10/1975 | Freiborg | 52/518 |

FOREIGN PATENT DOCUMENTS

| | | | |
|---|---|---|---|
| 237875 | 1/1961 | Australia | 52/95 |

*Primary Examiner*—James L. Ridgill, Jr.

*Attorney, Agent, or Firm*—Blakely, Sokoloff, Taylor & Zafman

[57] ABSTRACT

Asphalt composition shingles for new roofing and reroofing which provide a three dimensional appearance not unlike shake but with the characteristic lower cost and fire retarding characteristics of asphalt composition materials. The shingles may be cut from a standard roll of asphalt composition material, and are then folded to provide regions of differing thicknesses because of the differing number of thicknesses of the material in the various regions. The shingle design allows reroofing over existing shake roofs without requiring the stripping of the old roof. Various embodiments are disclosed.

18 Claims, 21 Drawing Figures

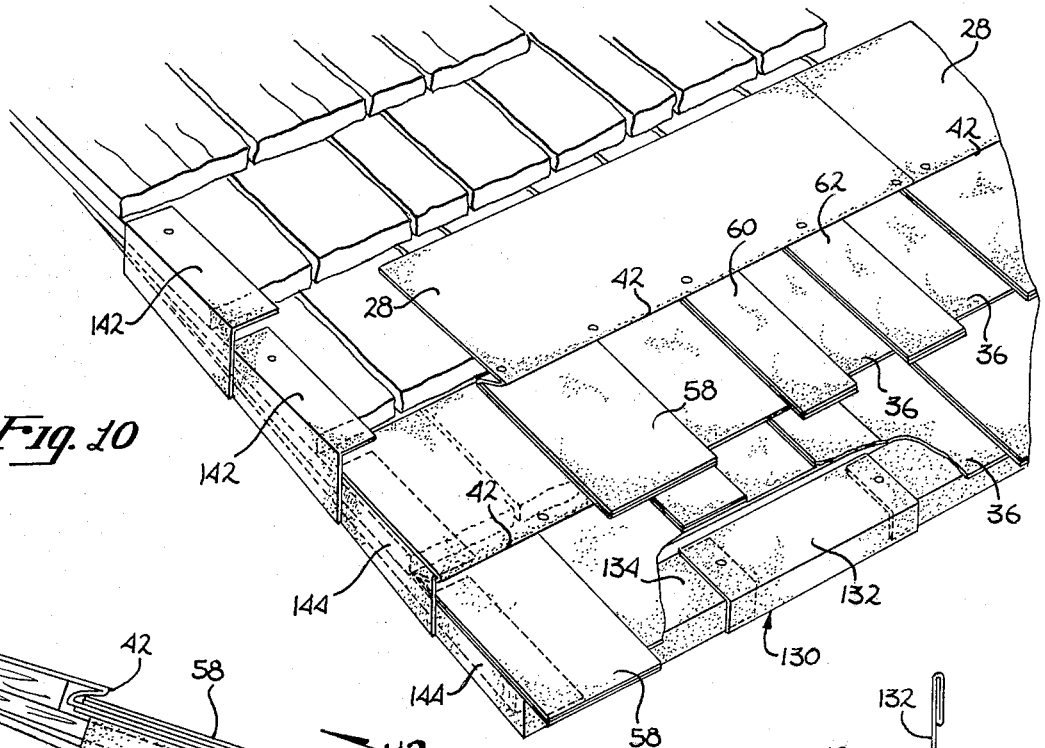
Fig. 10
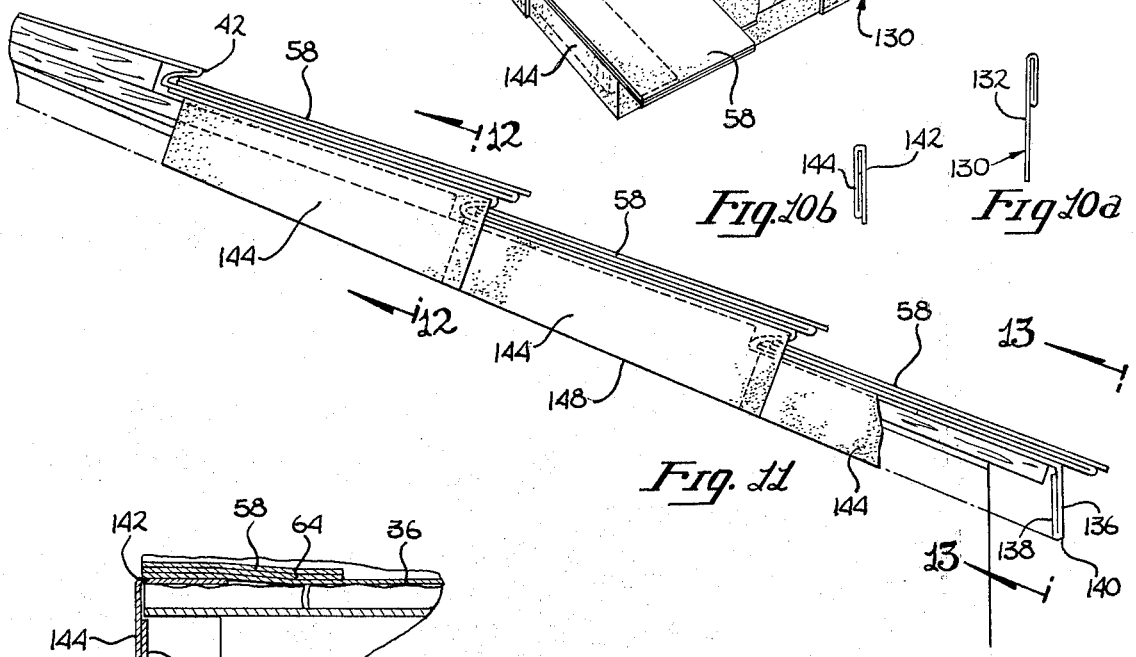
Fig. 10b
Fig. 10a
Fig. 11
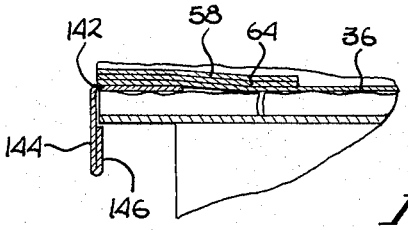
Fig. 12
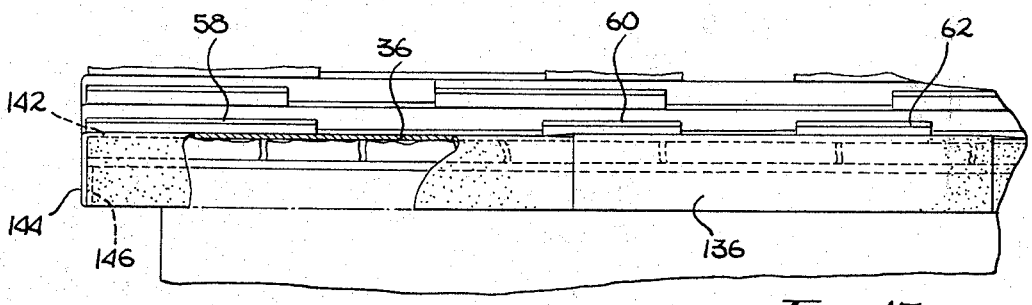
Fig. 13

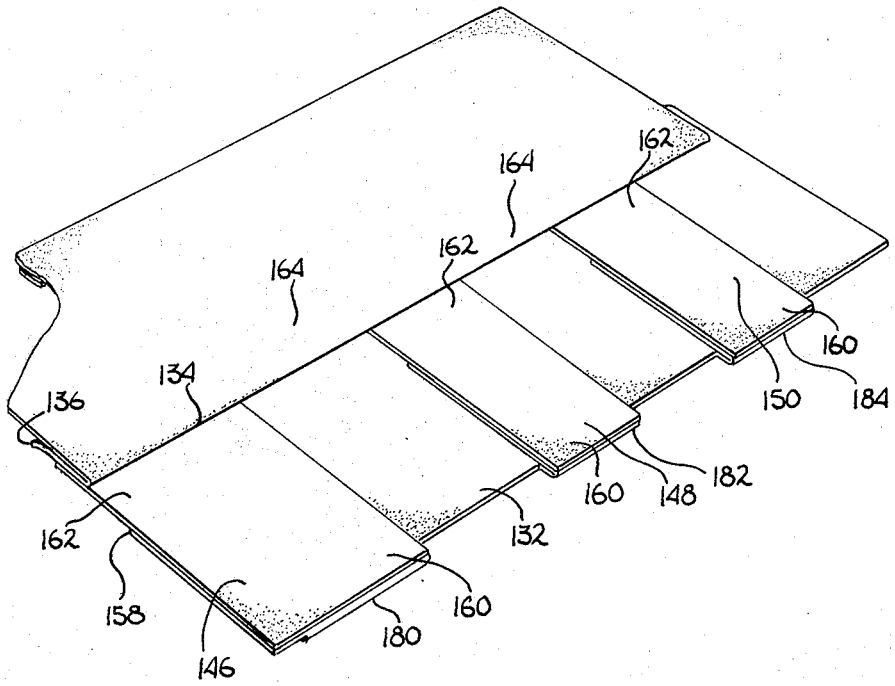
Fig. 16
Fig. 17
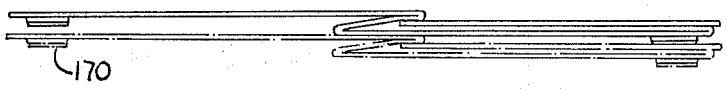
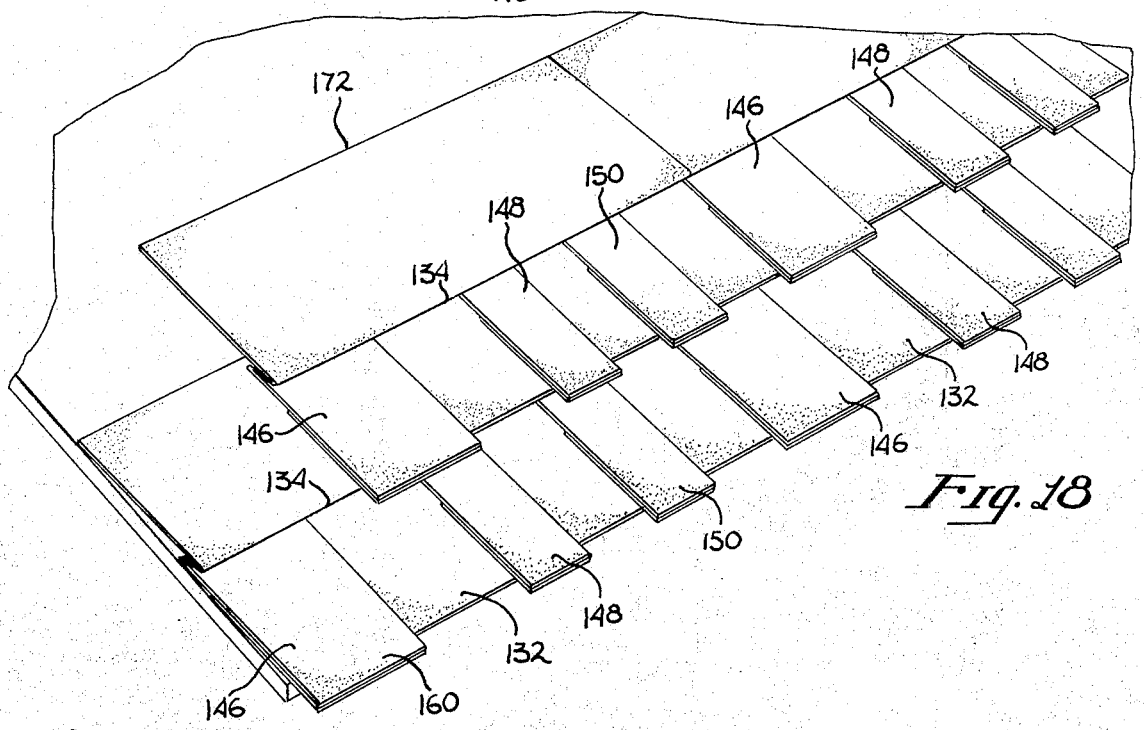
Fig. 18
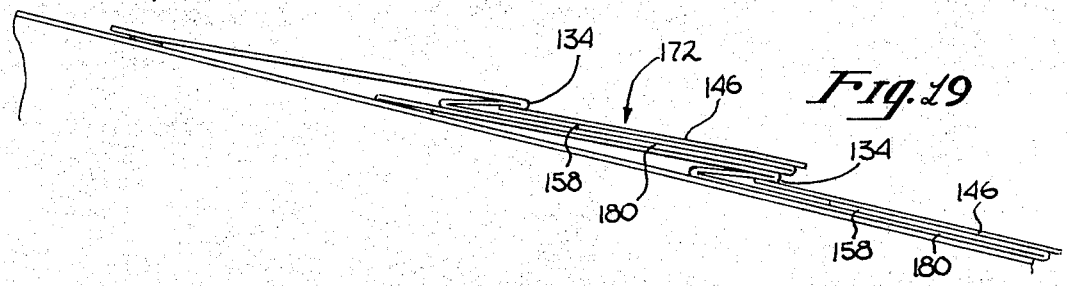
Fig. 19

ASPHALT COMPOSITION SHINGLES

BACKGROUND OF THE INVENTION

1. Field of the Invention

The present invention relates to the field of roofing, and more particulrly, non-metallic roofing such as asphalt composition and woodshake roofing.

2. Prior Art

Asphalt composition roofing of various types is very well known in the prior art. Such materials are characterized by a base layer of felt-like material, saturated with asphalt, and having a layer of asphalt on one surface thereof binding an outer layer of granules thereto. Such materials are relatively inexpensive and of light weight, thereby finding wide usage, though historically have been characterized as providing a relatively flat (i.e. non-three dimensional) roof, thereby having a minimal decorative character. Also, asphalt composition roofing, whether by way of conventional shingles or otherwise, has historically utilized a highly repetitive pattern in the roofing, thereby again limiting the decorative characteristic of the roof.

In certain instances in the prior art, asphalt composition materials had been folded for various purposes, including folding to provide improved sealing characteristics and folding to create regions of increased thickness to provide some better three-dimensional characteristic. Such folding however, was in general limited, with the resulting roof again having the highly repetitive design generally characteristic of asphalt composition roofs. Examples of such folding may be found in U.S. Pats. No. 1,410,299; 1,435,623; 1,596,272; 1,848,965; 1,975,986; and 2,253,753. In U.S. Pat. No. 3,913,294 an asphalt composition hip and ridge cover giving a highly pronounced three-dimensional characteristic is disclosed, this ridge cover providing a building silloutte resembling that of a building with a shake roof. Shingles of a similar character however, have heretofore not been known, except for the general type of shingle or shingle-like roofing exemplified by the foregoing prior art. In recent years, to enhance the appearance of asphalt composition shingles, various techniques have been used, including the use of varying thicknesses of the asphalt layer over the base material to provide variation in the shingle thicknesses, and use of a different color granule on the lower portion of the shingle to provide a shading effect to provide the illusion of a deeper three-dimensional roof.

BRIEF SUMMARY OF THE INVENTION

Asphalt composition shingles for new roofing and reroofing which provide a three dimensional appearance not unlike shake but with the characteristic lower cost and fire retarding characteristics of asphalt composition materials. The shingles may be cut from a standard roll of asphalt composition material, and are then folded to provide regions of differing thicknesses because of the differing number of thicknesses of the material in the various regions. The shingle design allows reroofing over existing shake roofs without requiring the stripping of the old roof. Various embodiments are disclosed.

BRIEF DISCRIPTION OF THE DRAWINGS

FIGS. 10 through 13 illustrate the accessories for finishing the gable end and eaves of a roof.

FIGS. 10*a* and 10*b* are cross-sectional details of the accessories of FIG. 10.

Figure 14:
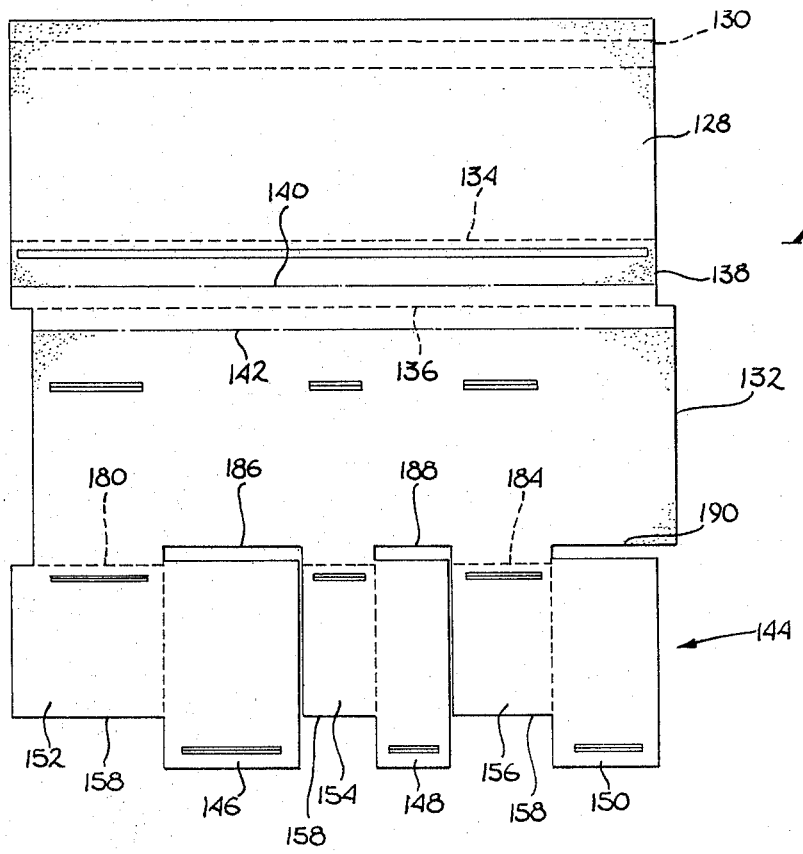

FIG. 14 is a plan form for a shingle blank for making an alternate embodiment of the present invention.

Figure 15:
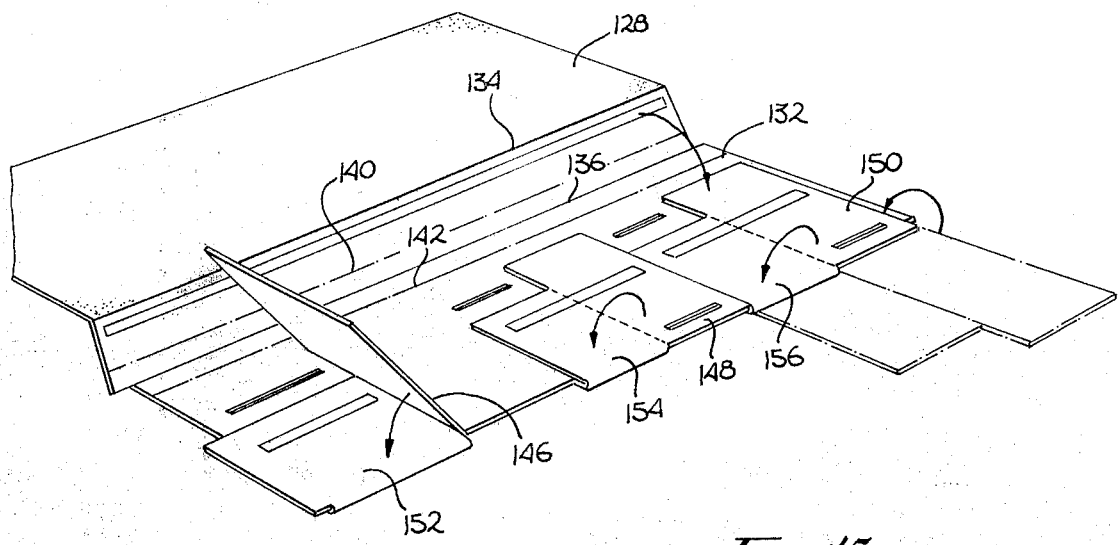

FIG. 15 illustrates the folding of the embodiment of FIG. 14.

FIG. 16 is a perspective view partially cut away of th embodiment of FIGS. 14 and 15.

FIG. 17 is an end view of shingles illustrating the stacking thereof.

FIGS. 18 and 19 illustrate the visual appearance of the installed shingles of this alternate embodiment.

DETAILED DESCRIPTION OF THE INVENTION

Figure 1:
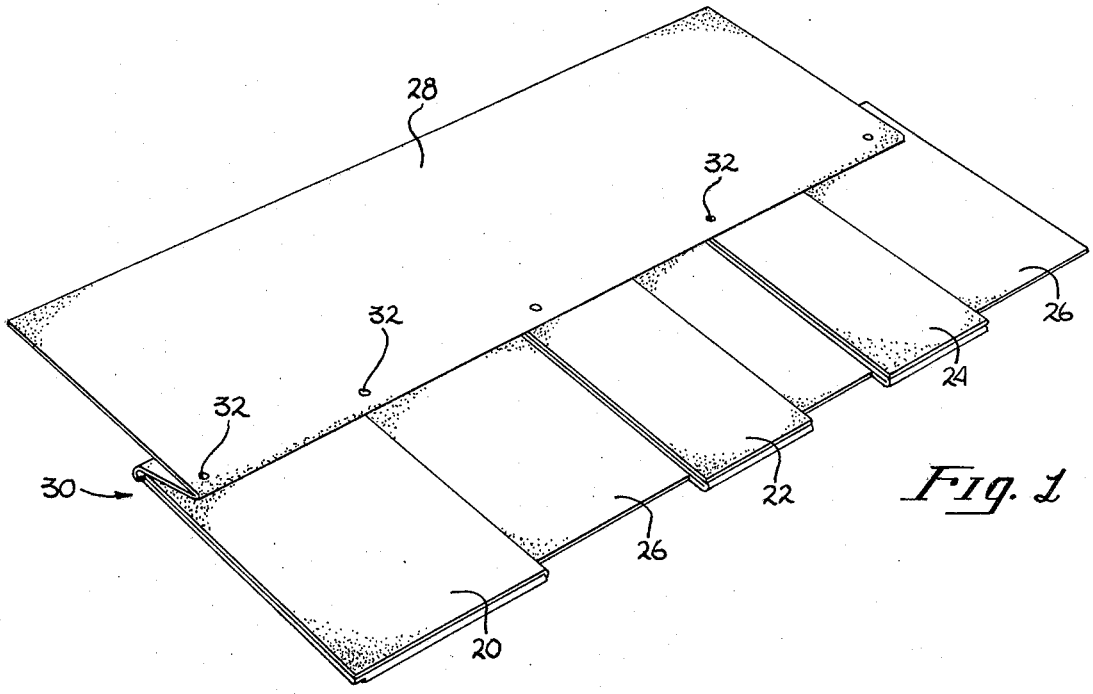
FIG. 1 is a perspective view of a shingle in accordance to the present invention.

First referring to FIG. 1, a perspective view of one shingle in accordance with the present invention may be seen. This shingle, formed from a unitary sheet of asphalt composition roofing material, is characterized by regions 20, 22 and 24 of three thickness of material, with regions 26 therebetween of a single material thickness. For enhanced visual appearance, regions 20, 22 and 24 extend lower than regions 26 to give a saw-toothed characteristic to the lower edge of the shingle. A second course underlayer is provided by upper panel 28 coupled to the lower course through a "Z" fold in region 30. Preferably, nail holes 32 are provided along the lower edge of panel 28 through which the shingles are nailed in place, as shall be subsequently described in greater detail.

Figure 2:
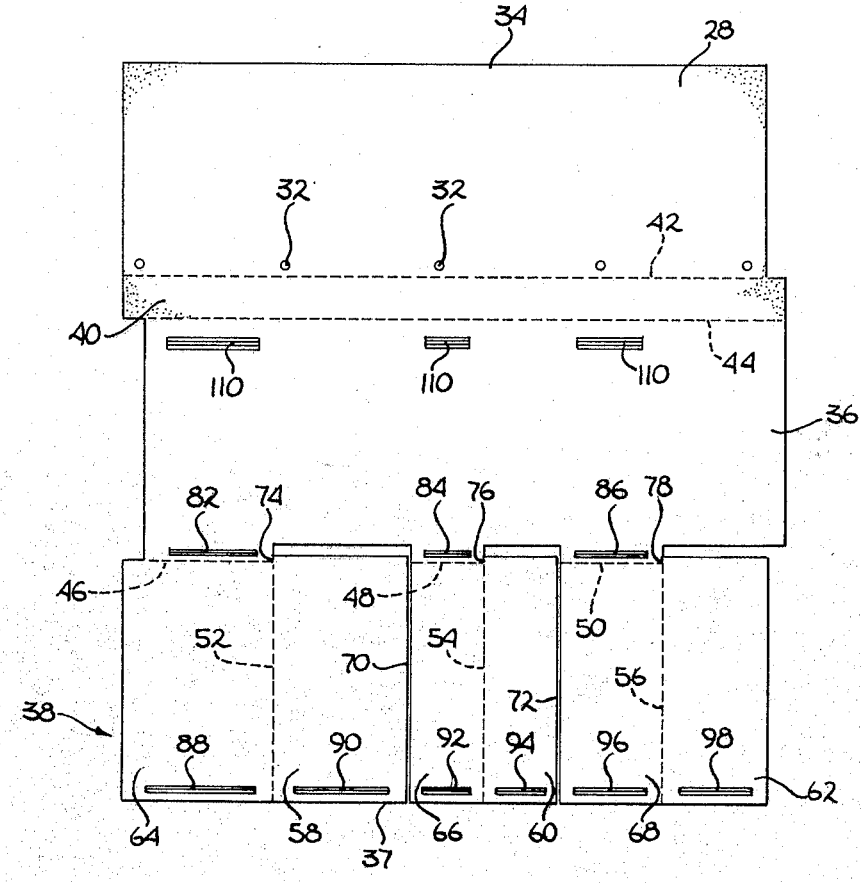
FIG. 2 is a plan view of a shingle blank from which the shingle of FIG. 1 is made.

The shingle of FIG. 1 is fabricated from a single sheet of conventional asphalt composition material, preferably a ninety pound material, though other weights may be used as desired. Since the invention involves the folding of the asphalt composition roofing material, the preferred method of fabrication contemplates automated cutting and folding equipment directly in line with the asphalt composition roofing production equipment, so that cutting and folding of the material as required may readily be accomplished while the material still remains quite warm. Alternatively of course, standard rolls of the material may be preheated before processing so as to more readily facilitate folding. In any event, a shingle blank in accordance with the outline of FIG. 2 is first cut from the standard roll. In this regard the distance from the top edge 34 of panel 28 to the lower edge 37 of the shingle blank may conveniently be made equal to the width of a standard roll so that waste material is minimized.

The blank shown in FIG. 2 is shown in a face-up position, i.e. as it would be viewed from the granule coated side. It is also configured for installtion from left to right going up the roof in accordance with conventional roofing practice. The blank has three basic regions, each inter-cooperating to provide the desired end result in the finished tile. Aside from the upper region 28, there is an intermediate region 36 and a lower region generally indicated by the numeral 38. The upper region 28, is integrally coupled to the intermediate region 36 through a section 40 by fold lines 42 and 44 (fold lines 42 and 44, as shall subsequently be explained in greater detail, may represent lines or regions specially configured for ease of folding, or may in fact only represent the lines about which folding will subsequently be accomplished without special preparation of the fold region for that purpose). Similar fold lines 46, 48 and 50 separate the lower portions 38 from the intermediate region 36 with fold lines 52, 54 and 56 separating panels 58, 60 and 62 from the adjacent panels 64, 66 and 68 respectively. It will be noted that panels 58, 60 and 62 are separated along their top edge from the intermediate region 36 by small rectangular cut outs, with panels 58, and 60 being separated from the adjacent panels 66 and 68 respectively by appropriate cuts 70 and 72 respectively. While panels 58, 60, 62, 64, 66 and 68 share a common lower edge 37, panels 58, 60 and 62 are slightly wider than panels 64, 66 and 68, respectively, and as is somewhat exaggerated in FIG. 2, the upper edges of panels 58, 60 and 62 are disposed slightly above the line defined by the fold lines 46, 48 and 50, with small slits 74, 76 and 78 extending along the small portion of the lines defined by fold lines 52, 54 and 56, respectively, above the line defined by the fold lines 46, 48 and 50.

Finally, in the preferred embodiment strips of asphalt adhesive are applied to the shingle blank of FIG. 2 in regions 82, 84, 86, 88, 90, 92, 94, 96 and 98. Also, as shall subsequently be seen, preferably asphalt adhesive is also applied to the undersurface of the blank in the regions directly under regions 88, 90, 92, 94, 96 and 98, and also in corresponding regions adjacent the top of the panels in the lower portion 38, specifically in regions just below the line defined by fold lines 46, 48 and 50. These adhesive regions will subsequently be visible and specifically identified in the subsequent figures illustrating the folding of the blank of FIG. 2.

Figure 3:
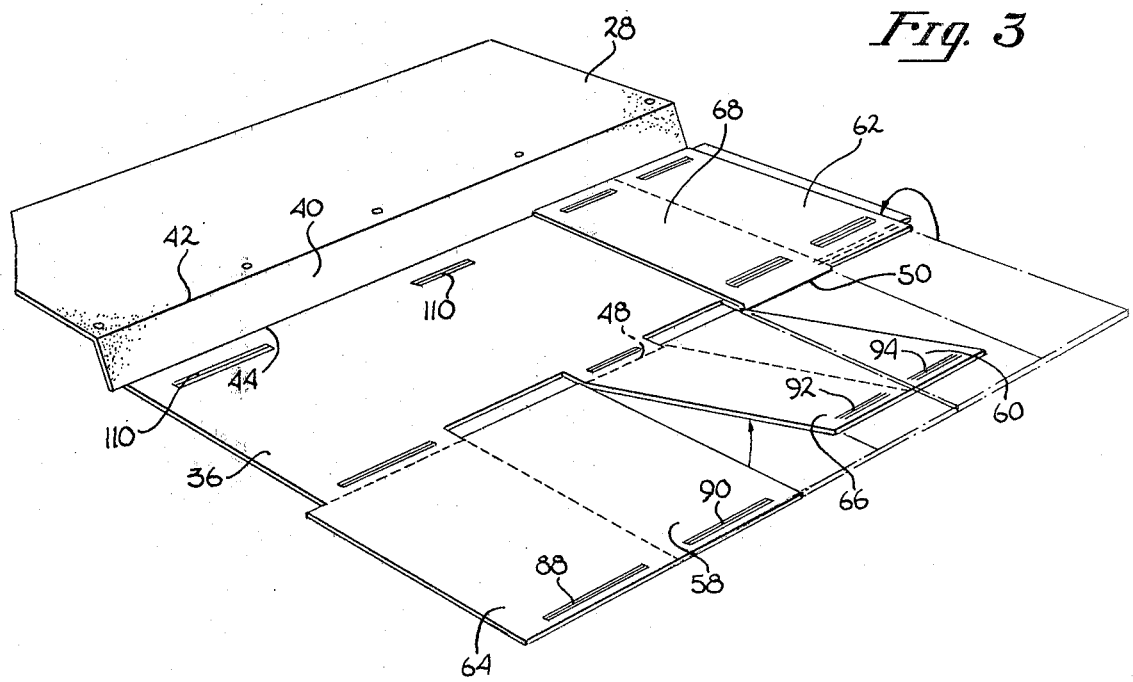
FIGS. 3 through 6 illustrate the folding of the shingle of FIG. 1.
Figure 4:
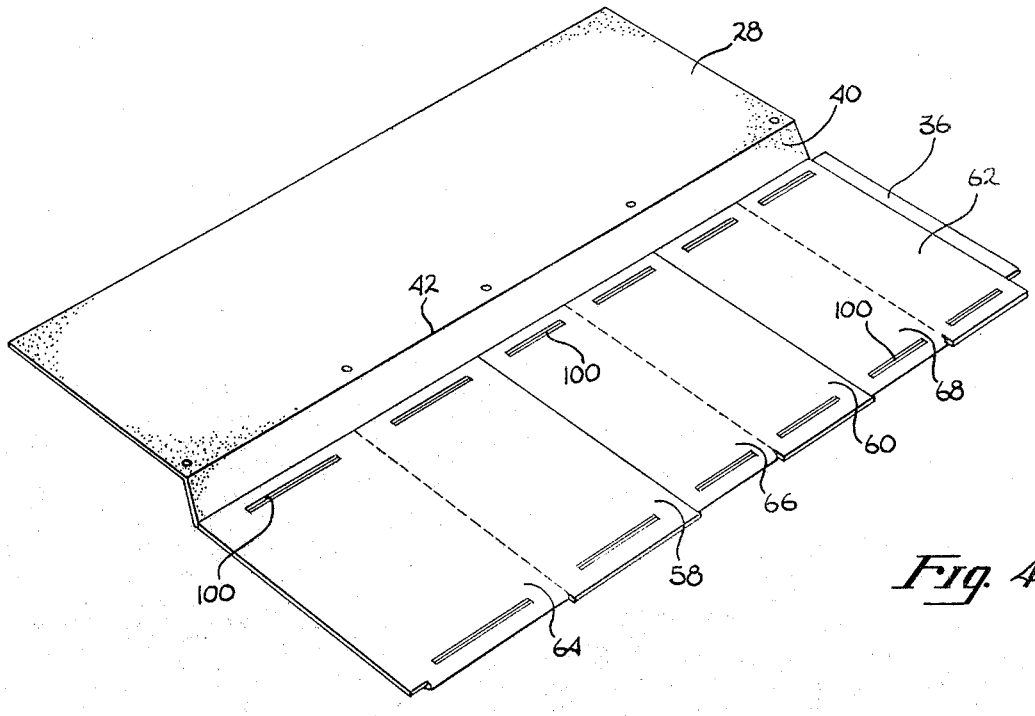

Now referring to FIG. 3, the initial steps in the folding of the shingle blank of FIG. 2 may be seen. In particular, as illustrated in this figure, panel 68 together with the adjacent integral panel 70 has been folded upward along fold line 50 to lie flat against the upper-face of intermediate panel 36. As will be appreciated, this type of fold is the more difficult type of fold for such materials, as the layer of asphalt and granules on the top surface of the material tends to accumulate in the fold region so as to put the underlying felt layer in tension. If such a fold is attempted with cold material, breaking of a felt layer may occur. However, if folded while the material is still warm, such folds may readily be accomplished without detriment to the material. In the alternative or in addition, the granules in at least a portion of the asphalt layer may be scraped or otherwise removed along the fold line to further accomodate folding, to define the fold line to assure folding occurs along the proper line, and/or to accomodate folding of cooler material. Also shown in FIG. 3 is the partial folding of panels 66 and 60 about fold line 48, with FIG. 4 illustrating completion of the folds shown partially in FIG. 3. Also illustrated in these Figures is a partial folding about lines 42 and 44. Also, as previously mentioned, the asphalt adhesive strips 100 initially applied to the lower surface of the blank of FIG. 2 are now visible, in FIG. 3, and more particularly FIG. 4. Of course, in the fold illustrated in FIG. 3 the adhesive region 86 (see FIG. 2) is brought into tight facial contact with the upper face of panel 68 so as to secure the panel thereto adjacent the fold.

Figure 5:
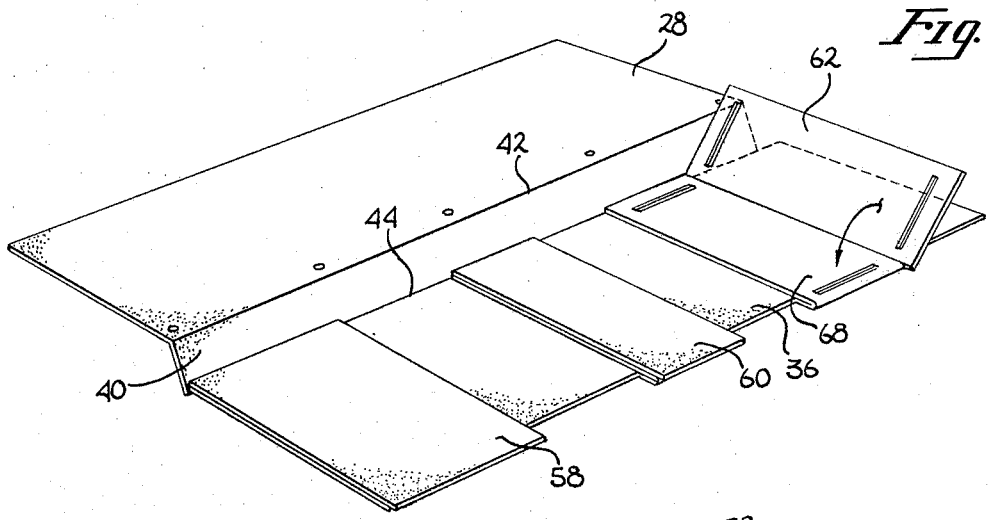
Figure 6:
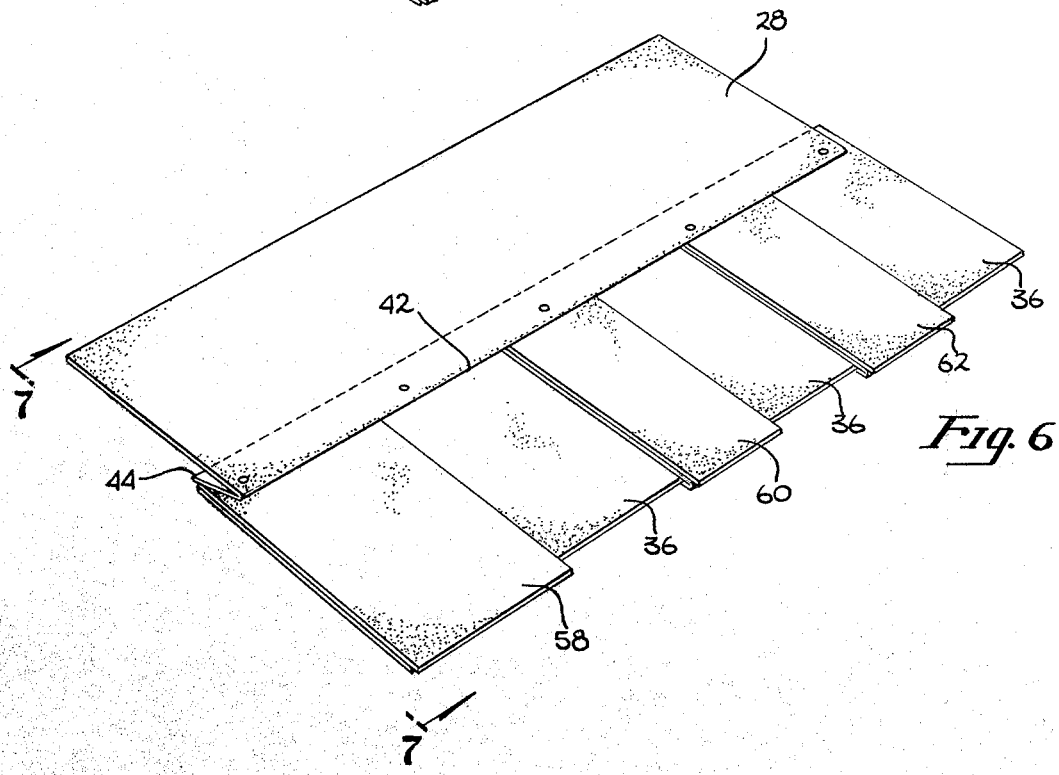

Now referring to FIG. 5 another of the folds is illustrated, in particular panel 62 is being folded about fold line 56 so as to ultimately lie flat against the back face of panel 68. As shown in FIG. 6, in this folding the back faces of the blank of FIG. 2 are brought into face to face abutment, with the cooperatively disposed adhesive regions securing the folded assembly. With the folds shown in FIG. 5 finally being completed, the finished shingle appears as shown in FIGS. 1 and 6, the thicker region 24 (FIG. 1) having a top surface defined by the top granuled layer of panels 62, with the thinner regions 26 therebetween being defined by the granuled surface of the intermediate region 36 of the blank shown in FIG. 2.

Figure 7:
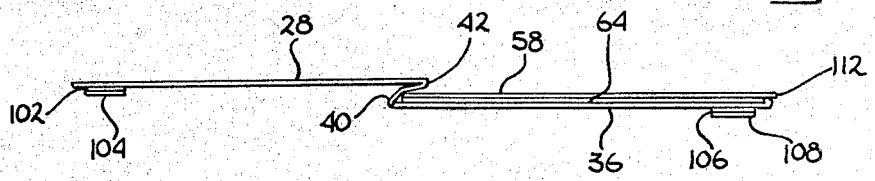
FIG. 7 is an end view of the shingle of FIGS. 1 and 6.

An end view of the completed shingle may be seen in FIG. 7. Under the upper panel 28 is a layer of asphalt adhesive 102 normally covered with cellophane or some other suitable covering 104 for protection during shipment. Region 40 essentially provides a "Z" fold to allow the upper panel 28 to have any reasonable variation in elevation (on installation) with respect to the intermediate panel 36. Of course, with the end view shown, also visible is the edge of panel 64 and the edge of panel 58 thereabove Along the lower edge of the intermediate region 36 preferably is another layer of asphalt adhesive 106 again, protected during shipment by a suitable, peelable protective layer 108.

It will be noted that FIGS. 3 through 6 perhaps imply a specific folding order, though clearly the folding order need not be as implied by these Figures. In particular the initial downward folding of panels 58, 60 and 62 would perhaps be more convenient, whether or not the 180 degree fold was accomplished prior to the initiation of the folds about fold lines 46, 48, and 50. Also, if desired, asphalt adhesive may be placed in suitable strips just below fold line 44 on the top surface of intermediate region 36 in regions 10 so that both ends of the thickened sections 20, 22 and 24 (FIG. 1) immediately become permanently bonded to resist shifting during shipment.

It was previously noted that the upper edge of panels 58, 60 and 62 (see FIG. 2) was slightly above the line defined by fold lines 46, 48 and 50 so that the lower edge 112 of the finished shingle extends slightly below the fold thereunder so as to create a shadow effect and generally hide the fold. Similarily, as previously mentioned, panels 58, 60 and 62 are slightly wider than the adjacent panels 64, 66 and 68 so that a slight shadow effect is also created along the edges of the thickened regions 20, 22 and 24 of the finished shingle.

Figure 8:
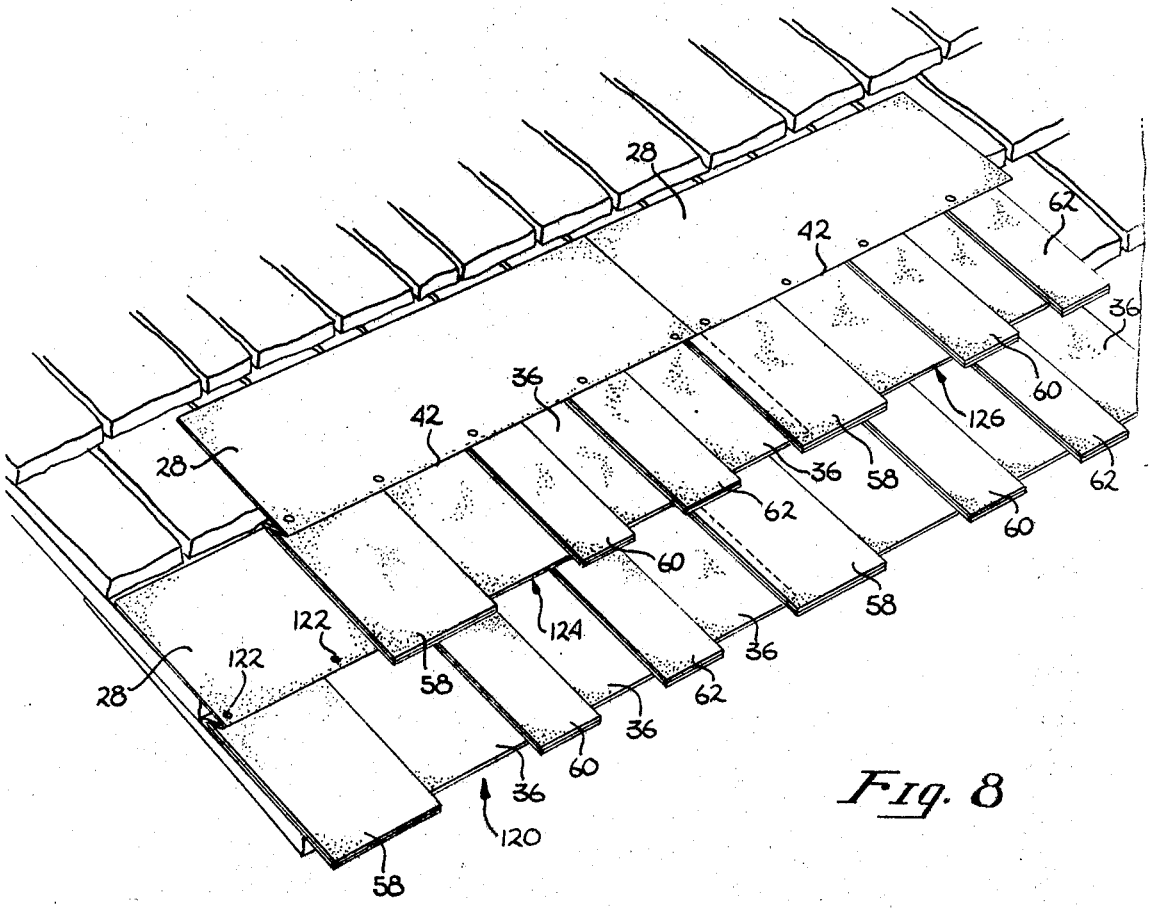
FIGS. 8 and 9 illustrate the application of the shingle of FIG. 1 to re-roofing of shake roofs.
Figure 9:
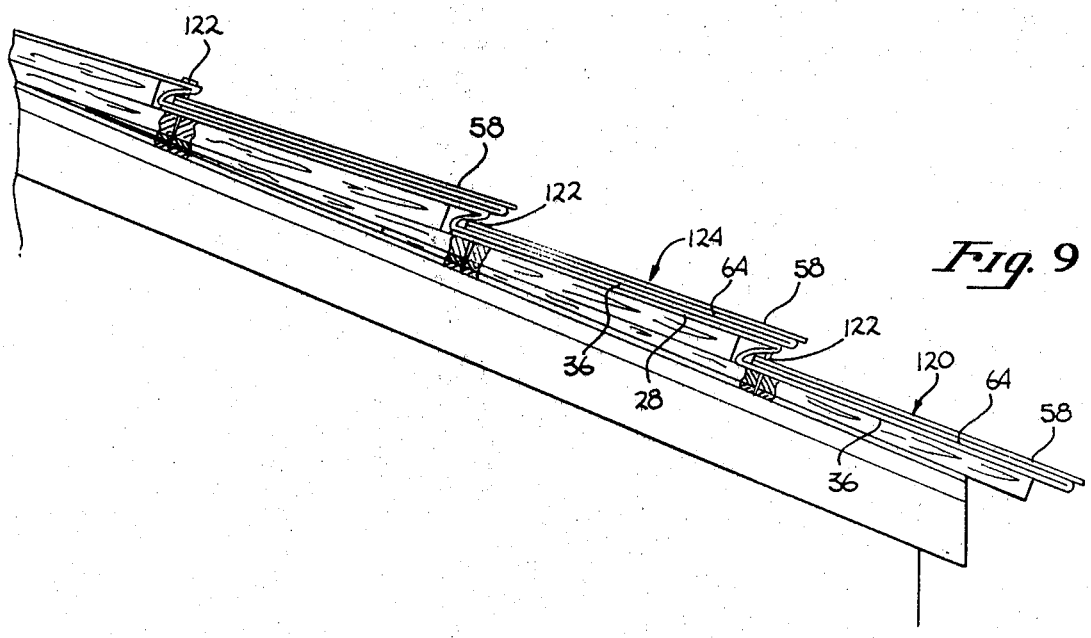

Now referring to FIGS. 8 and 9 the general application of the shingles of the present invention to a preexisting wood shake roof may be seen. It should be noted that FIG. 8 particularly is exemplary only as it illustrates a portion of a first course of shingles and a lesser portion of a second course. Further, the left edge of the roof of FIG. 8 is not in fact a finished edge but rather represents a roof section, the finishing of a gable end eaves being subsequently described with respect to FIGS. 10 through 13. Since the roofing proceeds normally from right to left on a course by course basis, shingle 120 of FIG. 8 would be placed in position and nailed in regions 122 prior to the disposition of shingle 122 thereover and the fastening of that shingle with appropriate nails. Note that region 20 of shingle 122 overlies the right-hand portion of adjacent shingle 120 to provide a high integrity water barrier in that area. As the second course proceeds, shingles are placed in position from right to left on the second course, with the lower portion of the shingles, such as shingles 124 and 126, overlying the upper panel 28 of the lower shingles. The net effect is to create a relatively random pattern resembling shake as a result of the alternate thick and thin regions, with the lower edge of each shingle providing a substantial shadow region thereunder because of the thicknesses created by the folding. In that regard the extent of shingle overhang shown in FIGS. 8 and 9 is somewhat exagerated for clarity, though the extent of the overhang may be adjusted as is desired for the best visual and physical characteristics. In that regard too, the position of each course with respect to the next lower course is not critical and may be adjusted somewhat in a vertical direction depending upon the exact position of the shake to be covered, and randomly set horizontally to avoid any apparent repetitive pattern. Further, it should be noted in FIG. 2 that panels 58, 60 and 62 may each be of somewhat different size to add to the variation and randomness in appearance. Also, if desired, the fold lines 46, 48 and 50 (see FIG. 2) need not be co-linear or the upper portions of the cutouts immediately thereabove be of equal size, so that after folding to form the completed tile the lower edges of the various thickened regions are staggard as is the lower edge of intermediate region 36 therebetween. Such staggering, however, has not been found required to achieve a highly decorative and attractive roof, though of course, this is always a possibility if desired.

Now referring to FIGS. 10 through 13 the accessories for finishing the eaves and gable and of the roof may be seen. On the eaves, finishing members generally indicated by the numeral 130 are nailed across the lower edge of the roof prior to the placement of the first course thereover. These members are characterized by an upper panel section 132 through which retaining nails 134 are driven, and a lower section characterized by a facing panel 136 and a back panel 138 formed integral therewith by a fold along the lower edge of the installed unit. Preferably the accessory for finishing the eaves is shipped with the fold along lines 140 and with asphalt adhesive between the facing surfaces of panels 136 and 138 for permanently securing the two panels together. In this manner the facing panel 136 is reinforced by the back panel 138 and appearance of the entire unit is enhanced when viewed from under the eaves. The eave finishing accessory hides the lower edge of the shake being covered, which otherwise would provide an unattractive contrast between the butt end of the lower course of shake and the asphalt composition tile covering the roof.

Along the gable edge of the roof a unit similar to the eave finishing accessory is used, though of somewhat different proportion. In particular, this unit is characterized by a first panel 142 which essentially overlies the edge of one course of shake, with an integral downward projecting panel 144 and an integral folded back panel 146 adhesively secured thereto in much the same manner as the back panel 138 of the eave finishing accessory. Preferably the panel 144 is tapered to approximate the sawtooth slope of the shake courses so that the lower edge 148 of the gable finishing members is approximately straight (perfect straightness of this lower edge is not required, as some irregularity will also add to the character of the finished roof). The gable finishing members are generally laid lower course first on a course by course basis, and may be overlapped as required to account for slight variations in the course to course spacing of the shakes themselves. For packaging convenience and to positively define all fold lines, preferably both accessories are shipped in the fully folded condition as shown in FIGS. 10(*a*) and 10(*b*), to be partially unfolded on installation.

Obviously some provision must also be made for suitable coverage of valleys, though this may be readily done by "L" shaped members or right angle members having a length slightly greater than the shake, which members are laid in the valleys on a course by course basis prior to the laying of the tile of the present invention. Finally, the ridge cover of U.S. Pat. No. 3,913,294 may be used for ridge finishing in a manner complimentary to the general appearance of the entire roof created by the tile of the present invention.

Now referring to FIGS. 14 through 19 another embodiment of the present invention may be seen, this embodiment is particularly suited for new roofing and for re-roofing applications other than re-roofing over shake. As may be seen in FIG. 14 the shingle blank is similar to that of FIG. 2, though certain specific changes have been made therein to better accomodate roofing over flatter surfaces i.e., surfaces which are flatter than existing shake roofing. The upper portion 128 of the blank in similar to the upper portion 28 of the earlier embodiment, and is provided with a layer of asphalt adhesive 130 on the upper back surface thereof. This upper pane 128 is separated from the intermediate section 132 by a pair of fold lines 134 and 136 defining a region 138 therebetween for forming a "Z" fold between panels 128 and 132. Fold line 134 may be simply an imaginary line with no special provisions being made for the folding as shown in FIG. 15. Fold line 136 however, preferably is located within a region defined by lines 140 and 142 between which the granules and most of the asphalt layer have been scraped away. While the scraping accomodates the folding, it is also done to provide a tapering in the folded thickness, as shall subsequently be seen.

The lower portion 144 of the blank is made up of panels 146, 148, 150, 152, 154 and 156 similar in construction and function to panels 58, 60, 62, 64, 66 and 68 in the blank of FIG. 2. However, it will be noted that panels 152, 154 and 156 all have a co-linear lower edge, which lower edge is substantially above the lower edge of panels 146, 148 and 150. When the panels are folded as shown in FIG. 15, the lower edge 158 of panels 152, 154 and 156 only reaches part way up the intermediate portion 132, so that when the folding is complete (see FIG. 16) the lower edge 158 falls in position below the fold line 134. Thus, each of the panels 146, 148 and 150 are comprised of a lower portion 160 of three thicknesses of asphalt composition roofing material and an upper portion 162 of only two thicknesses of material. In the region 164, except adjacent the left edge finished panel there are four thicknesses of the asphalt composition roofing material, specifically, the two thicknesses of material immediately adjacent the fold line 134, the thickness of panels 146, 148 and 150 and the thickness of the intermediate panel 132 therebelow. Slightly above region 164 closer to fold line 136 there are only three thicknesses of material as the edge of panels 146, 148 and 150 do not extent upward that far, and still closer to fold line 136 there are three thicknesses of material two of which have had the granules and part of the asphalt layer scraped away.

As before, appropriate placement of asphalt adhesive assures that the tile of the present invention will be secured during shipping and will not be disturbed by winds or other environmental effects on installation. In that regard, the tiles of the present invention may be readily stacked for shipping as shown in FIG. 17, with the exposed adhesive layers being protected by suitable strips of cellophane 170. On installation the various panels 172 are installed in the same manner as the previous embodiment, with the thickened regions providing a very strong three-dimensional effect simulating shake, as may be seen in FIGS. 18 and 19. Of course, on installation the same accessories may be used as hereinbefore described.

There has been disclosed and described herein two embodiments of a new and unique shingle which utilizes lightweight and relatively inexpenses asphalt composition roofing material to achieve a roofing product having a highly pronounced three-dimensional characteristic simulating the general appearance of shake roofing. From the disclosure herein given it will be obvious that various other changes may be made in the invention to create even a greater random appearance. By way of example the fold lines 180, 182 and 184 (see FIG. 14) might be located at slightly different elevations so that the lower edges of the shingle defined by fold lines 180, 182 and 184 (see FIG. 16) would be staggered. Obviously, the depth of the cut-out 186, 188 and 190 could also be staggered so that the lower edge of intermediate panel 132 is staggered between panels 146, 148 and 150 in the finished shingle. While the extent of such staggering which could be used and still provide the appropriate overlaps may be limited, a desirable effect could still be achieved thereby. Further, even the lower edge 158 of panels 152, 154 and 156 could be staggered so that any tendency of the lower edge 158 to print through the panels in the finished roof would still appear to create a random pattern. These variations, of course, are merely exemplary of the type of variations which may be used to still acheive the desired effect of the present invention without deviating from the spirit and scope thereof.

I claim:

1. A shingle comprising a unitary sheet of asphalt composition roofing material characterized by a substrate of asphalt saturated felt and a layer of granules on the top surface thereof bonded to the saturated felt by a layer of asphalt, said unitary sheet having an upper region, an intermediate region and a lower region, a first portion of said lower region being folded upward about a first fold line between said intermediate region and said lower region to lie flat against the top surface of said intermediate region, the remaining portion of said lower region being folded about at least one fold line approximately perpendicular to said first fold line to overlie, top surface up, said first portion of said lower region which in turn overlies a portion of said intermediate region.

2. The shingle of claim 1 wherein said remaining portion of said lower region is slightly larger than the first portion of said lower region so that at least some of the edges of said first portion of said lower region are hidden by the remaining portion of said lower region folded thereover.

3. The shingle of claim 1 wherein at least some of the adjacent surfaces of the folded unitary sheet are secured to each other by asphalt adhesive.

4. The shingle of claim 1 wherein said first portion of said lower region comprises a plurality of first panels and said remaining portion of said lower region comprises an equal plurality of second panels each integral with a respective one of said first panels, each of said first panels being folded upward about a fold line between said intermediate region and said lower region to lie flat against respective areas of the top surface of said intermediate region, said second panels each being folded about a fold line approximately perpendicular to said first fold line to overlie, top surface up, a respective said first panel.

5. The shingle of claim 4 wherein said second panels are different size.

6. The shingle of claim 4 wherein a small portion of said intermediate region above said second panels and above said fold lines between said first panels and said intermediate region is cut away whereby the lower edge of the shingle is staggered.

7. The shingle of claim 4 further comprised of a "Z" shaped fold between said intermediate region and said upper region, the top of said "Z" shaped fold overlying the adjacent edge of said second panels.

8. The shingle of claim 7 wherein the granules and at least a part of the asphalt layer have been removed in the region of the lower fold in said "Z" shaped fold.

9. The shingle of claim 7 wherein each of said second panels is slightly larger than the respective said first panel integral therewith.

10. The shingle of claim 7 wherein said second panels are of different size.

11. A shingle comprising a unitary sheet of asphalt composition roofing material characterized by a substrate of asphalt saturated felt and a layer of granules on the top surface thereof bonded to the saturated felt by a layer of asphalt, said unitary sheet having an upper region, an intermediate region and a lower region, said lower region having a number of first panels each integrally coupled along the top edge thereof to the adjacent lower portion of said intermediate region along a fold line, said lower region also having an equal number of second panels each separated from said intermediate region thereabove and integrally coupled along one side to a respective one of said first panels along a fold line, each of said first panels being folded upward along said fold line between the respective said first panel and said intermediate region to lie flat against said top surface of said intermediate region, each of said second panels being folded along said fold line between the respective said first and second panels to overlie the respective said first panel.

12. The shingle of claim 11 wherein said second panel are each slightly larger than the respective said first panel thereunder.

13. The shingle of claim 11 wherein at least some of the facingly disposed surfaces of the folded unitary sheet are secured by asphalt adhesive.

14. The shingle of claim 11 wherein the edge of said first panels underlies the said "Z" shaped fold.

15. The shingle of claim 11 wherein the edge of said first panels does not underlie said "Z" shaped fold.

16. The shingle of claim 11 further comprised of a "Z" shaped fold between said intermediate region and said upper region, the top of said "Z" shaped fold overlying the adjacent edge of said second panels.

17. The shingle of claim 16 wherein the granules and at least a part of the asphalt layer have been removed in the region of the lower fold in said "Z" shaped fold.

18. The shingle of claim 16 wherein said second panels are of different size.

* * * * *

UNITED STATES PATENT AND TRADEMARK OFFICE

CERTIFICATE OF CORRECTION

PATENT NO. : 4,322,928

DATED : April 6, 1982

INVENTOR(S) : Freiborg

It is certified that error appears in the above-identified patent and that said Letters Patent is hereby corrected as shown below:

| COLUMN | LINE | DESCRIPTION |
|---|---|---|
| 4 | 37 | Delete "10" and insert --110--. |
| 6 | 28 | Delete "pane" and insert --panel--. |

Signed and Sealed this

Seventh Day of April, 1987

*Attest:*

DONALD J. QUIGG

*Attesting Officer*

*Commissioner of Patents and Trademarks*